US007654866B2

(12) United States Patent
He et al.

(10) Patent No.: US 7,654,866 B2
(45) Date of Patent: Feb. 2, 2010

(54) UPRIGHT ELECTRICAL CONNECTOR

(75) Inventors: Jia-Yong He, Kunshan (CN); Qi-Sheng Zheng, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/890,955

(22) Filed: Aug. 8, 2007

(65) Prior Publication Data

US 2008/0038951 A1 Feb. 14, 2008

(30) Foreign Application Priority Data

Aug. 8, 2006 (CN) ..... 2006 2 0076280 U

(51) Int. Cl.
*H01R 13/648* (2006.01)

(52) U.S. Cl. ..... 439/607.01; 439/701

(58) Field of Classification Search ..... 439/607, 439/701, 607.01, 260

See application file for complete search history.

(56) References Cited

U.S. PATENT DOCUMENTS 5,092,795 A * 3/1992 Kitagawa ..... 439/668
6,095,861 A * 8/2000 Lin et al. ..... 439/607
6,315,608 B1 11/2001 Lopata et al.
6,402,554 B1 * 6/2002 Yeh ..... 439/607.39
6,447,311 B1 * 9/2002 Hu et al. ..... 439/108
6,863,569 B2 3/2005 Zhu et al.
7,044,790 B2 * 5/2006 Zhu et al. ..... 439/607
2005/0042923 A1 * 2/2005 Zhu et al. ..... 439/607

* cited by examiner

*Primary Examiner*—Tho D Ta
*Assistant Examiner*—Travis Chambers
(74) *Attorney, Agent, or Firm*—Wei Te Chung; Andrew C. Cheng; Ming Chieh Chang

(57) ABSTRACT

An upright electrical connector (100) includes an insulative housing (1) having a base portion (11) defining a mounting face (102), a first and a second tongue portions (312, 322) defining a mating face (101) and extending beyond the base portion; a number of first and second contacts (21, 20) retained in the insulative housing, the first contacts having first contacting portions (212) held in an inner surface of the first tongue portion, the second contacts having second contacting portions (202) held in an inner surface of the second tongue portion; an inner shell (5) mounted to the base portion, the inner shell defining four upwardly-extending side walls (51) enclosing the first and the second tongue portions to form an inner receiving space (53) being open through the mating face; and an outer shell mounted to the base portion, the outer shell comprising four upwardly-extending side walls (61) enclosing the base portion; the first and the second tongue portions are perpendicular to the mounting face.

16 Claims, 5 Drawing Sheets

UPRIGHT ELECTRICAL CONNECTOR

BACKGROUND OF THE INVENTION

1. Field of the Invention

The present invention relates to an electrical connector, and particularly to an upright electrical connector.

2. Description of Related Art

With the development of communication and computer technology, electrical connectors for high-speed data transmission are widely used in electronic systems. IEEE1394 (Institute of Electrical and Electronics Engineers; IEEE) connectors are commonly used to connect external and internal peripheral devices to a computer for performing high speed data transmission therebetween. These connectors typically employ a plug connector terminated to a transmission cable and a receptacle connector mounted on a circuit board of the computer.

U.S. Pat. No. 6,315,608 discloses a receptacle connector mounted on a circuit board. The receptacle connector comprises an insulative housing having a base portion and a mating portion extending forwardly from the base portion, a plurality of conductive terminals retained in the housing, an inner shell enclosing the mating portion of the housing for electromagnetic interference protection, and an outer metal shell enclosing both the housing and the inner shell for further electromagnetic interference protection. The mating portion is parallel to the circuit board. The conductive terminals are also arranged in the mating portion in a plane parallel to the circuit board. Nowadays, there are many electric elements to be mounted on the circuit board to perform multiply functions. However, the receptacle connector mentioned above will occupy much area of the circuit board. Under this case, there will be no adequate area to mount other electric elements on the circuit board.

It is thus desired to provide an improved connector to overcome the shortcomings described above.

SUMMARY OF THE INVENTION

An object of the present invention is to provide an electrical connector which will occupy relatively small area of a circuit board on which the electrical connector mounted.

In order to achieve above-mentioned object, an upright electrical connector comprises an insulative housing having a base portion having a mounting face, a first and a second tongue portions defining a mating face and extending beyond the base portion; a plurality of first and second contacts retained in the insulative housing, the first contacts having first contacting portions held in an inner surface of the first tongue portion, the second contacts having second contacting portions held in an inner surface of the second tongue portion; an inner shell mounted to the base portion, the inner shell defining four upwardly-extending side walls enclosing the first and the second tongue portions to form an inner receiving space being open through the mating face; and an outer shell mounted to the base portion, the outer shell comprising four upwardly-extending side walls enclosing the base portion; the first and the second tongue portions are perpendicular to the mounting face.

Other objects, advantages and novel features of the present invention will become more apparent from the following detailed description of the present embodiment when taken in conjunction with the accompanying drawings.

DETAILED DESCRIPTION OF THE INVENTION

Figure 1:
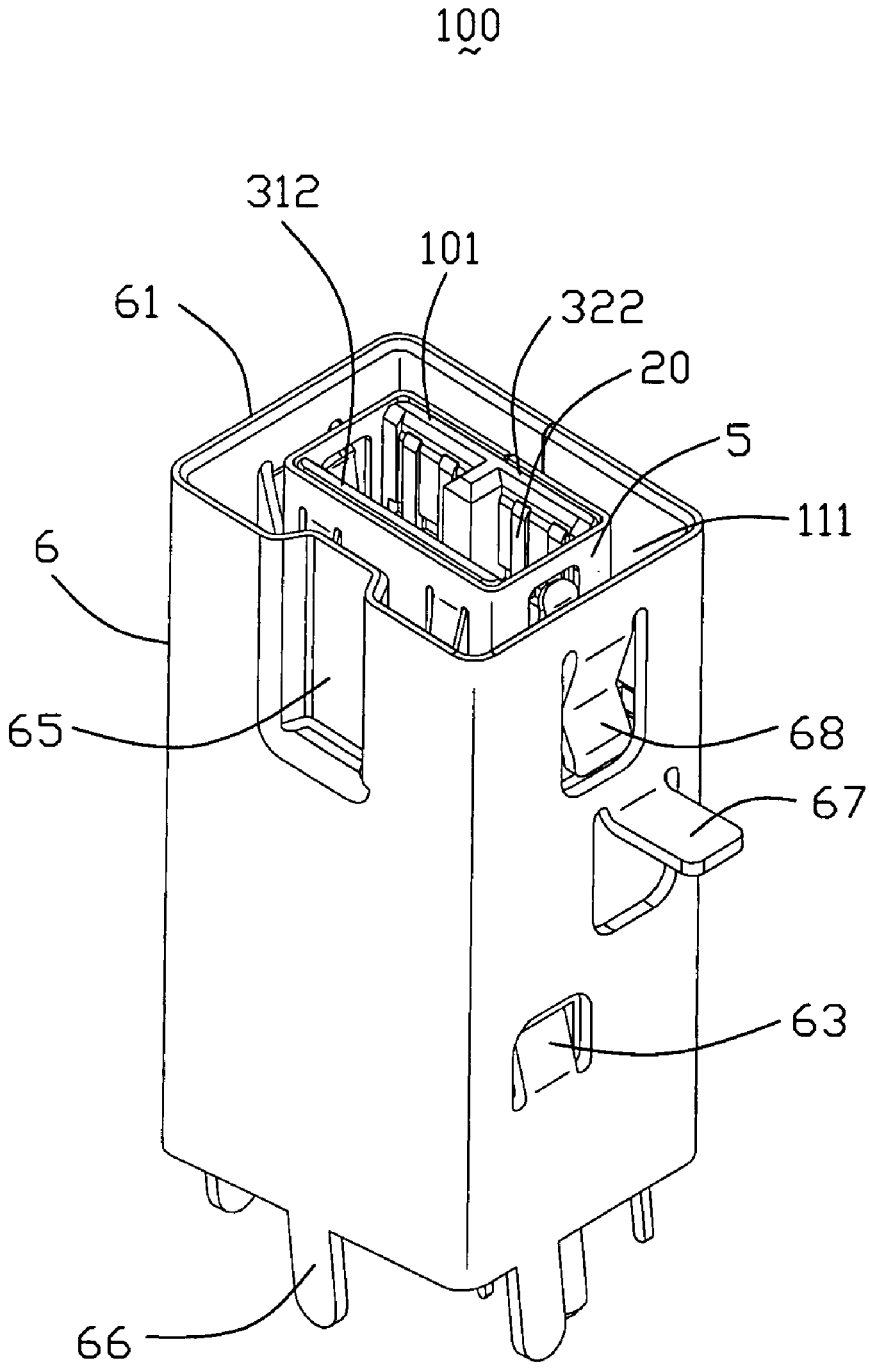
FIG. 1 is an assembled perspective view of an upright electrical connector according to the present invention.

Reference will now be made to the drawing figures to describe the preferred embodiment of the present invention in detail.

Figure 2:
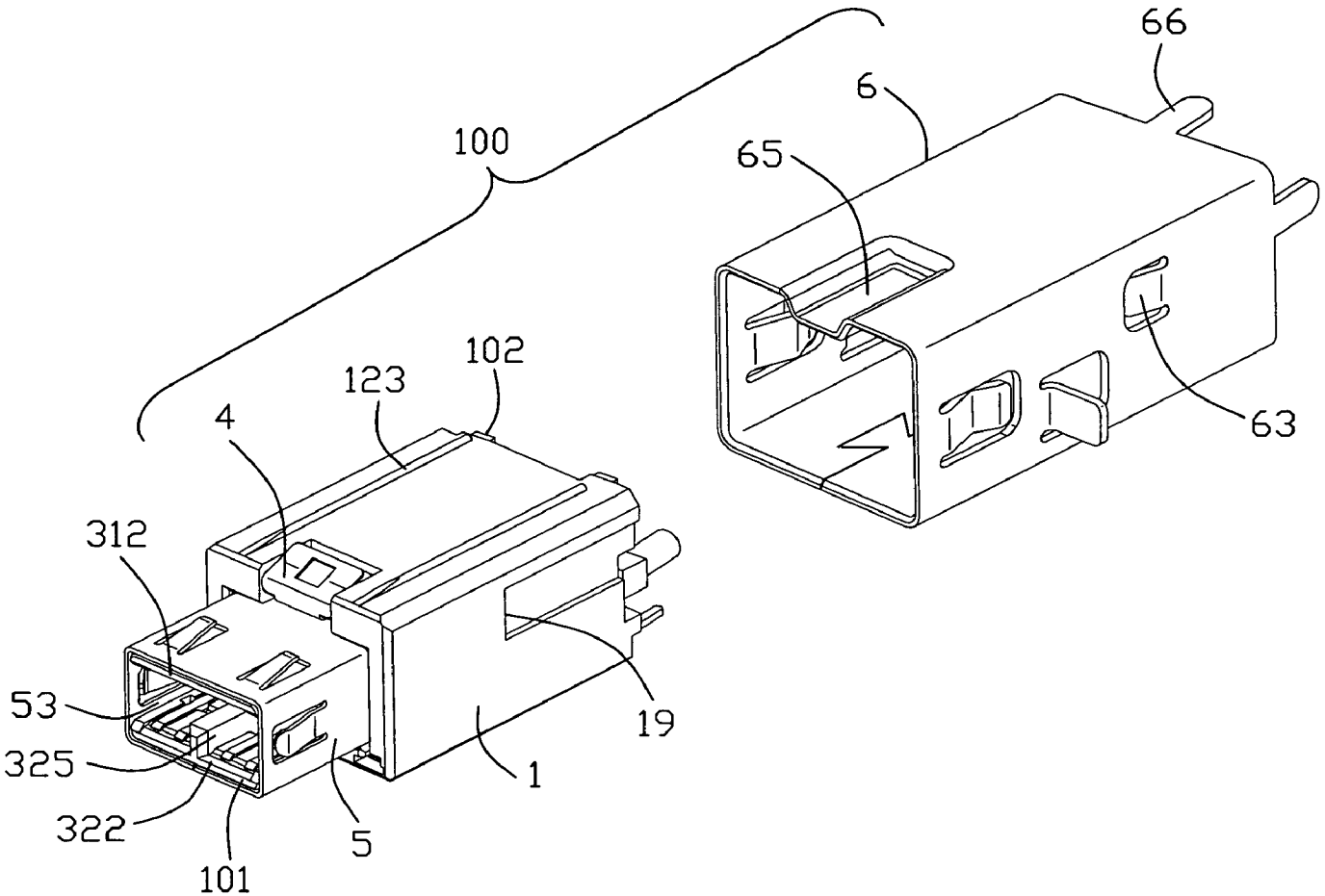
FIG. 2 is a partially exploded perspective view of the upright electrical connector shown in FIG. 1.
Figure 3:
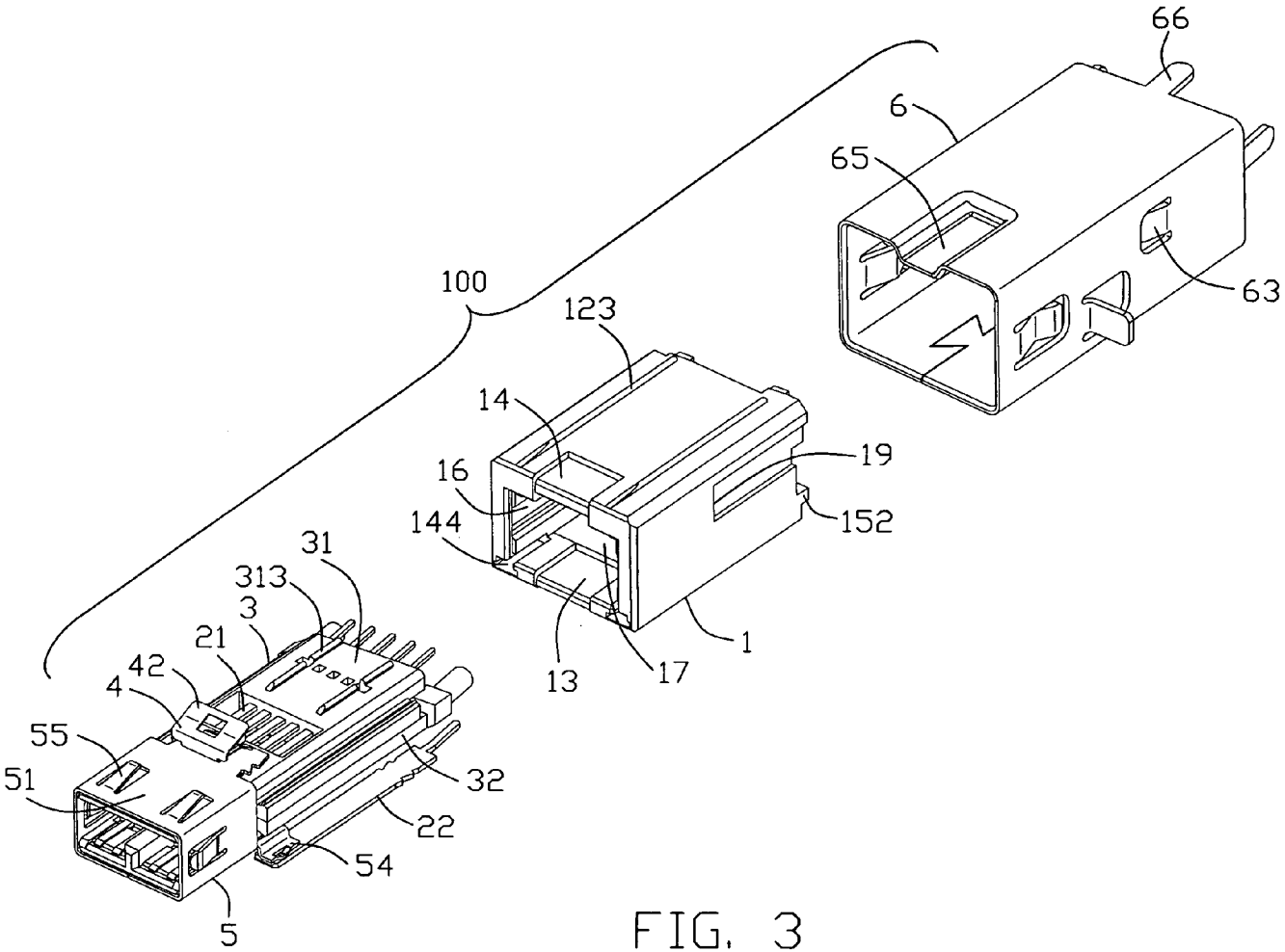
FIG. 3 is an another partially exploded perspective view of the upright electrical connector shown in FIG. 1.
Figure 4:
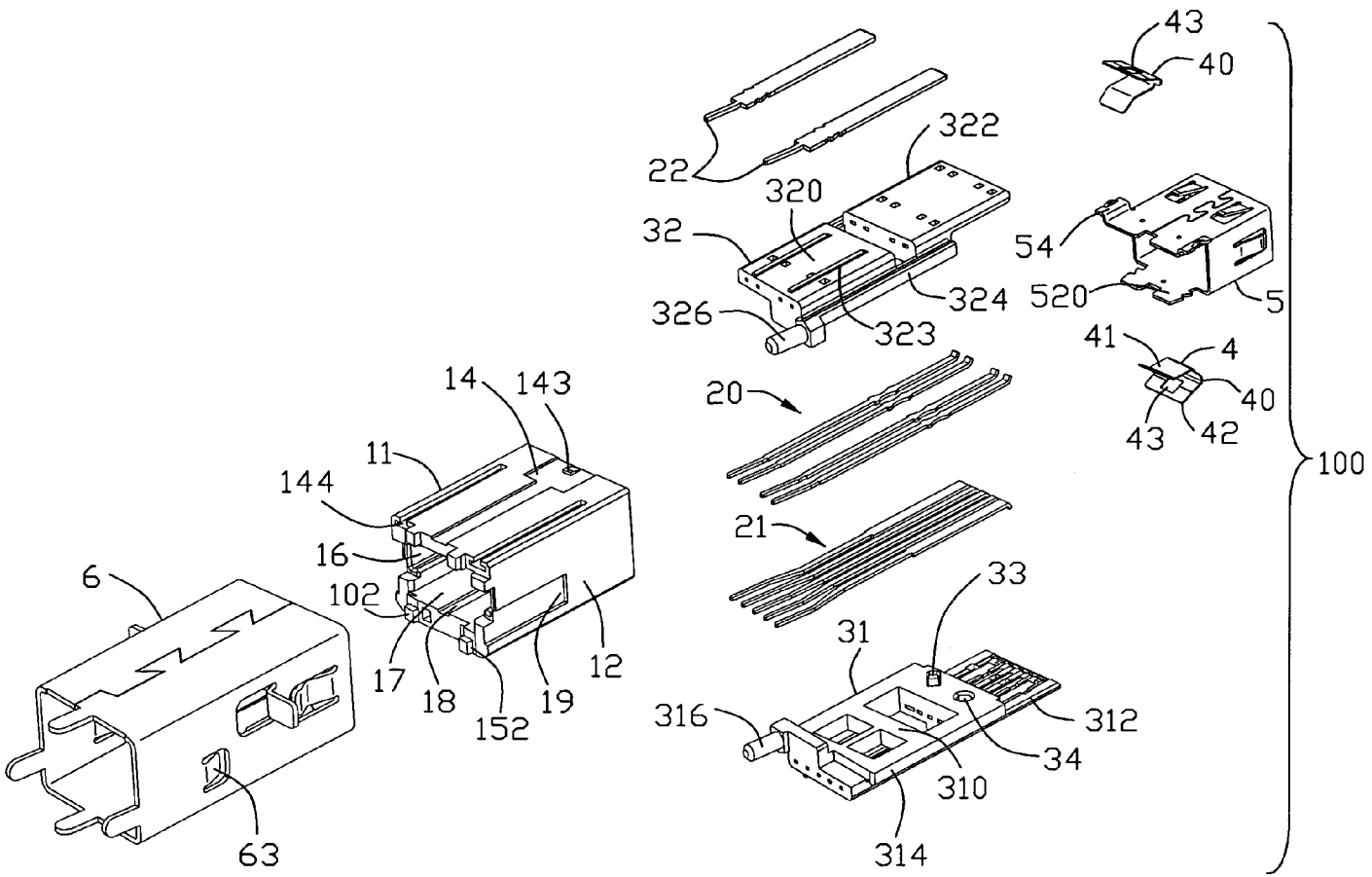
FIG. 4 is a fully exploded perspective view of the upright electrical connector shown in FIG. 1.
Figure 5:
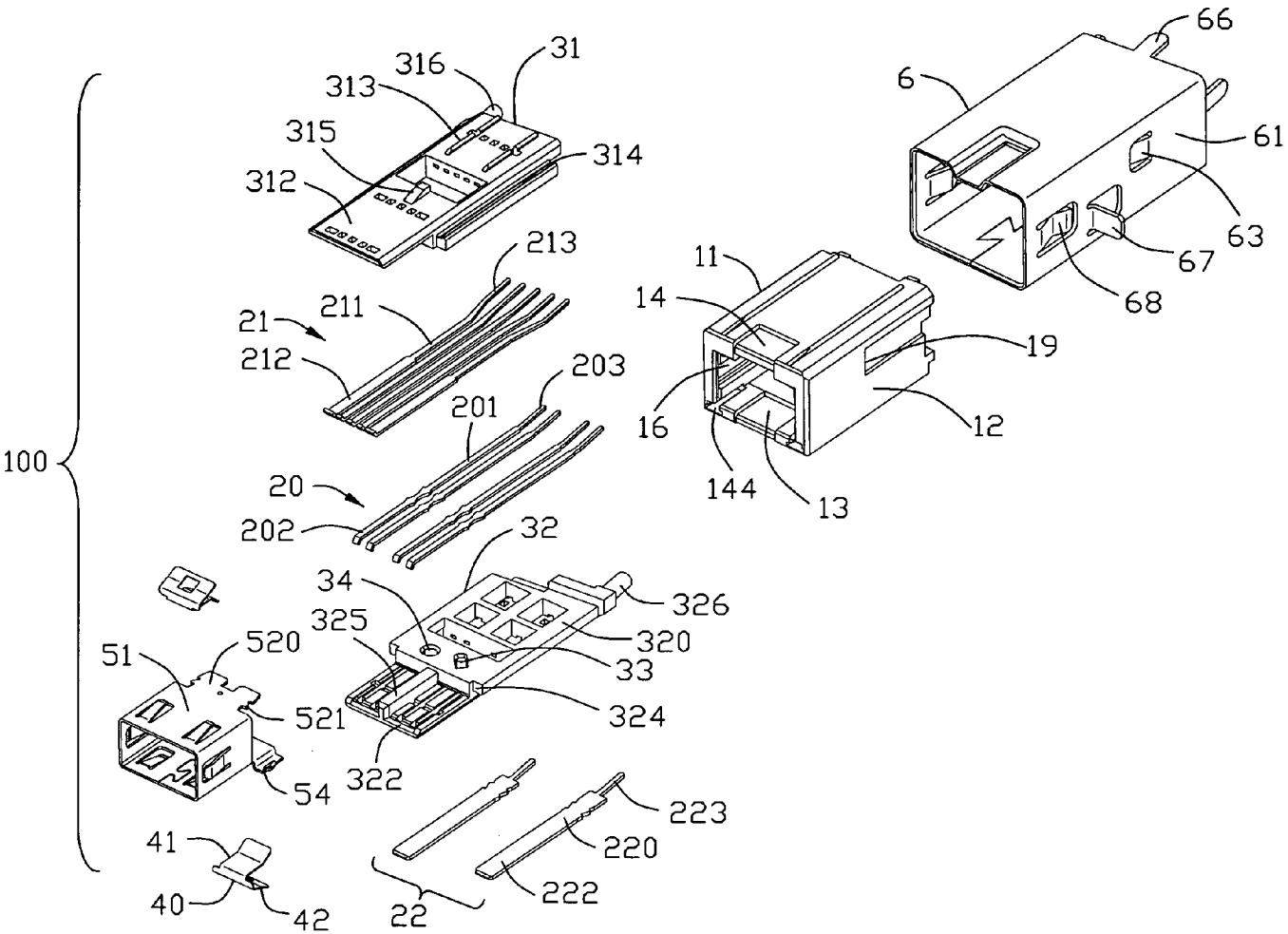
FIG. 5 is a view similar to FIG. 4, while taken from a different aspect.

Referring to FIGS. 1-6, an upright electrical connector 100 in accordance with the present invention defines an upper mating face 101 and a bottom mounting face 102 adapted for mounting on a printed circuit board (PCB, not shown), and comprises an insulative housing 1, a set of first contacts 20 and a set of second contacts 21 retained in the insulative housing 1, an inner shell 5 mounted on the insulative housing 1 to shield the insulative housing 1 and the first and the second contacts 20, 21, an outer shell 6 also mounted on the insulative housing 1 to further shield the first and the second contacts 20, 21, a pair of connecting elements 4 for connecting the inner shell 5 and the outer shell 6, a pair of grounding elements 22 mounted into the insulative housing 1 to contact with the inner shell 5.

The insulative housing 1 includes a base portion 11, a first mating plate 31 and a second mating plate 32 received in the base portion 11. In this specific embodiment, the base portion 11, the first mating plate 31 and the second mating plate 32 are separately manufactured. The base portion 11 defines an up-to-down direction, four side walls 12 extending upwardly and a receiving cavity 17 formed between the four side walls 12. The receiving cavity 17 extends through the base portion 11 in the up-to-down direction. A plurality of standoffs 152 are formed on bottom sides of the side walls 12 for abutting against the printed circuit board, bottom faces of the standoffs 152 commonly define the bottom mounting face 102 of the upright electrical connector 100. A pair of inner recesses 13 and a pair of outer recesses 14 are formed on inner and outer sides of two opposite side walls 12 of the base portion 11 respectively for receiving the connecting element 4. The side walls 12 define a pair of channels 144 along side edges thereof where adjacent side walls 12 are connected with each other, the channels 144 communicate with the receiving cavity 17 and extend through the base portion 11 in the up-to-down direction for securing the inner shell 5 and the grounding elements 22.

A pair of elongated grooves 16 are provided on inner sides of opposite side walls 12 of the base portion 11 and communicate with the receiving cavity 17. The first mating plate 31 and the second mating plate 32 are provided with a pair of projections 314, 324 extending laterally and outwardly respectively, the projections 314 of the first mating plate 31 and the corresponding projections 324 of the second mating plate 32 contact with each other to be secured in the groove 16 of the base portion 11. The first mating plate 31 has an inclined tab 315 protruding outwardly to be inserted in a guiding slot 18 formed on the base portion 11 and communicating with the receiving cavity 17. A number of ribs 313, 323 are formed on outer faces of the first mating plate 31 and the second mating plate 32 to abut against inner faces of the side walls 12 of the base portion 11.

The first mating plate 31 includes a first base plate 310 having a post 316 projecting downwardly therefrom and a first tongue portion 312 extending upwardly from the first base plate 310 in the up-to-down direction, the first tongue portion 312 is thinner than the first base plate 310. The second mating plate 32 includes a second base plate 320 having a post 326 projecting downwardly therefrom and a second tongue portion 322 extending upwardly from the second base plate 320 in the up-to-down direction, the second tongue portion 322 is thinner than the second base plate 320. The first mating plate 31 and the second mating plate 32 are fixed together via interferentially engagement between protrusions 33 and notch 34 formed on the first mating plate 31 and the second mating plate 32. The first tongue portion 312 and the second tongue portion 322 are parallel to and offset from each other. The upper mating face 101 is defined by the upper faces of the first tongue portion 312 and the second tongue portion 322, the upper mating face 101 is preferably oblique to the bottom mounting face 102. A central key 325 extends inwardly from a middle portion of the second tongue portion 322 for ensuring correcting insertion of a complementary connector.

The first contacts 21 and the second contact 20 are insert-molded in the first mating plate 31 and the second mating plate 32 respectively, and each comprises an upright intermediate portion 211, 201 fixed in the first mating plate 31 and the second mating plate 32 respectively, a contacting portion 212, 202 extending upwardly from the intermediate portion 211, 201, and a solder tail 213, 203 for soldering on the PCB. The contacting portion 212, 202 of the first and the second contacts 21, 20 are exposed on inner faces of the tongue portion 312, 322.

The connecting element 4 comprises a connecting portion 40 abutting against a front end of the base portion 11, an inner contacting portion 41 and an outer contacting portion 42 extending oppositely from the connecting portion 40. The inner and the outer contacting portions 41, 42 extend downwardly along opposite sides of the side wall 12 of the base portion 11 of the insulative housing 1 to be received in the inner recesses 13 and the outer recesses 14 respectively, the inner contacting portion 41 is adapted to contact with an outer face of the inner shell 5, the outer contacting portion 42 is adapted to contact with an inner face of the outer shell 6. The outer contacting portion 42 has a retaining hole 43 for securing a protrusion tab 143 formed in the outer recess 14 of the base portion 11.

The inner shell 5 and the outer shell 6 are stamped from a piece of metal sheet, respectively. The inner shell 5 encloses the first and the second tongue portion 312, 322 to define an inner receiving space 53 and comprises four upwardly-extending side walls 51. The inner shell 5 further comprises a retaining plate 520 extending downwardly therefrom and an engaging plate 54 extending downwardly and outwardly therefrom and facing the retaining plate 520. The retaining plate 520 is secured between inner faces of two opposite side walls 12 of the base portion 11. The engaging plate 54 is received in corresponding channel 144 of the insulative housing 1 and electrically connecting with the grounding elements 22 received in the channels 144. The grounding elements 22 each comprises a connecting portion 220, a contacting portion 222 extending from one end of the connecting portion 220 and a soldering portion 223 extending from the other end of the connecting portion 220 for electrically connecting with the printed circuit board.

The outer shell 6 is attached to the insulative housing 1 and surround the inner shell 5 to define a hollow cavity 111 therebetween for receiving part of the complementary connector. Similarly, the outer shell 6 comprises four upright side walls 61. An inwardly-depressed portion 65 is formed at an upper end of the side wall 61. The side wall 61 of the outer shell 6 is provided with a locking tab 63 projecting inwardly for locking with a recess 19 formed on the side wall 12 of the base portion 11. The side wall 61 of the outer shell 6 has a pair of position tabs 67 extending outwardly and laterally therefrom, a pair of spring tab 68 extending inwardly to contact with the complementary connector and a plurality of soldering legs 66 extending downwardly and inclinedly from bottom edges thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An upright electrical connector comprising:

an insulative housing comprising a base portion having a mounting face extending along a horizontal direction, a first tongue portion and a second tongue portion defining a mating face and extending beyond the base portion;

a plurality of first and second contacts retained in the insulative housing, the first contacts having first contacting portions held in an inner surface of the first tongue portion, the second contacts having second contacting portions held in an inner surface of the second tongue portion;

an inner shell mounted to the base portion, the inner shell comprising four upwardly-extending side walls enclosing the first tongue portion and the second tongue portion with an inner receiving space formed between the side walls of the inner shell and the first tongue portion and the second tongue portion, the inner receiving space being open through the mating face along a first direction oblique to the horizontal direction, the first and the second contacting portions being exposed to the inner receiving space; and an outer shell mounted to the base portion, the outer shell comprising four side walls extending upwardly and inclinedly to form an angle with respect to the horizontal direction, the outer shell enclosing the base portion, the first and the second tongue portions and the inner shell with a hollow cavity formed between the side walls of the inner shell and the side walls of the outer shell; and further comprising a first mating plate and a second mating plate, the base portion define a receiving cavity extending through an upper side and a lower side thereof for receiving the first mating plate and the second mating plate, the first and the second tongue portions are formed integrally with the first mating plate and the second mating plate respectively; the receiving cavity being recessed along the first direction.

2. The upright electrical connector as claimed in claim 1, wherein the first mating plate and the second mating plate define a plurality of ribs on outer sides thereof for engaging with inner faces of the base portion.

3. The upright electrical connector as claimed in claim 1, wherein the base portion has a guiding slot on an inner side thereof, the second mating plate defines an inclined tab guided into the guiding slot.

4. The upright electrical connector as claimed in claim 1, wherein the insulative housing has a plurality of standoffs extending from bottom edges therefrom, the mounting face is defined by bottom faces of the standoffs.

5. The upright electrical connector as claimed in claim 1, further comprising a connecting element mechanically and electrically connecting with an outer face of the inner shell and an inner face of the outer shell, the outer shell is of one piece construction.

6. The upright electrical connector as claimed in claim 1, wherein the outer shell defines a looking tab curved inwardly, the base portion has a recess on an outer side thereof and extending from a bottom edge thereof, the locking tab abuts against an inner face of the recess.

7. The upright electrical connector as claimed in claim 1, wherein the base portion defines a channel extending through an upper side and a lower side thereof and communicating with the receiving cavity.

8. The upright electrical connector as claimed in claim 7, further comprising a grounding element having a connecting portion secured in the channel, a contacting portion contacting with the inner shell and a soldering portion extending beyond the mounting face.

9. An upright electrical connector for mounting to a printed circuit board, comprising:

an insulative housing comprising a base portion defining a planar mounting face for mounting to a printed circuit board in a parallel relation, a first tongue portion and a second tongue portion defining a mating face facing toward an exterior and extending beyond the base portion, the first tongue portion being spaced apart from the second tongue portion;

a plurality of first contacts and second contacts retained in the first and the second tongue portion respectively, the first contacts having first upright contacting portions ranged in a first plane, the second contacts having second upright contacting portions arranged in a second plane being parallel to the first plane;

an inner shell mounted to the base portion, the inner shell comprising four upwardly-extending side walls, the inner shell enclosing the first and the second tongue portions with an inner receiving space formed between the side walls of the inner shell and the first and the second tongue portions, the inner receiving space being open through the mating face, the first and second contacting portions being exposed to the inner receiving space; and an outer shell mounted to the base portion, the outer shell comprising four upwardly-extending side walls to define a receiving room; all the insulative housing, the first contacts, the second contacts and the inner shell being received in the receiving room, the outer shell enclosing the base portion, the first and the second tongue portions and the inner shell with a hollow cavity formed between the side walls of the inner shell and the side walls of the outer shell; wherein the mating face is oblique to the mounting face.

10. The upright electrical connector as claimed in claim 9, further comprising a connecting element mechanically and electrically connecting with an outer face of the inner shell and an inner face of the outer shell.

11. The upright electrical connector as claimed in claim 9, wherein the outer shell has a plurality of soldering legs extending downwardly and inclinedly from bottom edges thereof, the outer shell is of one piece construction.

12. The upright electrical connector as claimed in claim 9, further comprising a grounding element connecting with the inner shell, the base portion defines a channel extending through an upper side and a lower side thereof, the grounding element is retained within the channel.

13. An electrical connector comprising:

an insulative inner housing with a plurality of contacts associated thereon;

a metallic inner shell attached to a front portion of the inner housing and defining a mating port thereof;

an insulative outer housing enclosing said inner housing;

a metallic outer shell assembled to and surrounding the outer housing; wherein a grounding device straddles the outer housing with a first leg mechanically and electrically engaged with the inner shell and a second leg mechanically and electrically engaged with the outer shell; wherein said inner housing includes two halves each having a mating tongue with associated contacts thereon and a mounting post thereof for mounting to a printed circuit board, the two halves being assembled to each other while the mating tongues being spaced from and opposite to each other, the mating tongue and the corresponding mounting post extending roughly in opposite directions.

14. The electrical connector as claimed in claim 13, wherein the center axis of the mounting post is essentially located on an interface plane between said two halves.

15. The electrical connector as claimed in claim 13, wherein the mating tongues of said two halves are opposite to each other in a horizontal direction while extending toward an exterior in an upward direction perpendicular to said horizontal direction, and the mounting post defines a center axis extending in a downward direction essentially oblique to both said horizontal direction and said upward direction.

16. The electrical connector as claimed in claim 15, wherein the outer shell defines a soldering leg extending in said downward direction.

* * * * *